US006854142B2

(12) United States Patent
Lukomskiy

(10) Patent No.: US 6,854,142 B2
(45) Date of Patent: Feb. 15, 2005

(54) DIAPER CHANGING STATION

(76) Inventor: Alexandr V. Lukomskiy, 3309 Bethany Bend, Alpharetta, GA (US) 30004

( * ) Notice: Subject to any disclaimer, the term of this patent is extended or adjusted under 35 U.S.C. 154(b) by 0 days.

(21) Appl. No.: 10/615,374

(22) Filed: Jul. 9, 2003

(65) Prior Publication Data

US 2005/0005360 A1 Jan. 13, 2005

(51) Int. Cl.[7] ..... A47D 5/00
(52) U.S. Cl. ..... 5/655; 5/648; 5/649
(58) Field of Search ..... 5/648–651, 655, 5/947, 603

(56) References Cited

U.S. PATENT DOCUMENTS 2,732,269 A * 1/1956 Astroff ..... 5/646
3,756,680 A * 9/1973 Lerner ..... 312/237
3,982,742 A * 9/1976 Ford ..... 5/649
4,136,859 A * 1/1979 Hulbert ..... 5/655
4,205,669 A * 6/1980 Hamann ..... 5/603
5,161,270 A * 11/1992 Najmabadi ..... 5/424
5,718,011 A * 2/1998 Nogues ..... 5/655
6,581,228 B1 * 6/2003 Boskovich et al. ..... 5/655
6,698,044 B2 * 3/2004 Greenfield et al. ..... 5/624

* cited by examiner

*Primary Examiner*—Michael Trettel
(74) *Attorney, Agent, or Firm*—Patent Focus, INC; Richard C. McComas

(57) ABSTRACT

A diaper changing table is a piece of furniture with a pad on top, two rods with stirrups and a foot pedal that raises the rods. The purpose of the invention is to provide a changing table, which holds a baby's leg in the proper position and at the same time raises the legs and buttocks. This allows the adult to change the diaper without using his/her hands to lift the baby's legs and buttocks. This is convenient because it allows the adult to apply the diaper and easily reach for the other needed things while the stirrups hold the legs of the child in place so that the child does not squirm out of position.

2 Claims, 3 Drawing Sheets

DIAPER CHANGING STATION

CROSS REFERENCE

Disclosure document # 497254, filed on Jun. 24, 2001.

FIELD OF INVENTION

This invention holds a baby's legs and raises the legs and buttocks while the diaper is being changed.

BACKGROUND OF INVENTION

Newborn baby needs diapers and it needs to be changed often. When baby gets older, it gets more complicated to change its' diaper, especially when a baby learns how to roll.

On regular diaper changing tables, you must hold a baby's legs with one of your hands, while the other hand cleans baby and reaches for all the other things you need, all at the same time.

Therefore, there is a need to provide a changing table which can hold a baby's legs in proper position, and that can raise the legs and buttocks at the same time. This allows the adult to change the diaper without using his/her hands to lift the baby's legs and buttocks, thus allowing the adult to use both hands to properly change the baby.

SUMMARY OF INVENTION

Briefly described, this present invention is a piece of furniture; it is a horizontal wall, with a pad resting on the top of it. The baby lies on the pad. There are openings in the top wall in two places, near the front and near the back. The rods are adjustable to suit the age of the child.

The idea basically is, that each of the rods would have a stirrup for holding the legs of the baby elevated above the pad. There are two stirrups, one on each side. A rod assembly on each side holds a stirrup, and the rods are movable up and down in response to a depression of a foot pedal at the bottom of the main piece of furniture. The foot pedal is connected to a lever that lifts a horizontal crossbar. The crossbar is connected at the ends to the upright rods.

The rods are telescopically arranged and there is a setscrew that fastens the two rods together so that they do not slip.

The idea is that if the stirrup needs to be a little higher or a little lower, the setscrew can be loosened, the rods can be adjusted in length and the setscrew could be tightened again to fasten the rods back together. When the person steps on the foot pedal the rods move up and the baby's legs in the stirrups on the upper ends of the rods are lifted. This allows the adult to use both hands to change the baby. It is thus easier to take off the diaper, clean the baby and slip on the new diaper without having to use his/her hands to lift the baby.

This is so convenient in the sense that it helps the adult to apply the diaper while the stirrups hold the child's legs in place so that the child does not squirm out of position.

The object of this invention is to provide a diaper-changing table with a rise-up mechanism and stirrups to hold baby's legs as well as to provide a possibility to use both hands change baby's diaper.

Another object of this invention is to provide a convenient place that is safe and holds a baby in proper position so that its' diaper can be changed properly and with ease.

In addition to the use of this device for a child, a larger version of this could be used for a disabled person.

DETAILED DESCRIPTION

Referring now in more detail to the drawings, in which like numerals indicate like parts throughout both illustrations.

Figure 1:
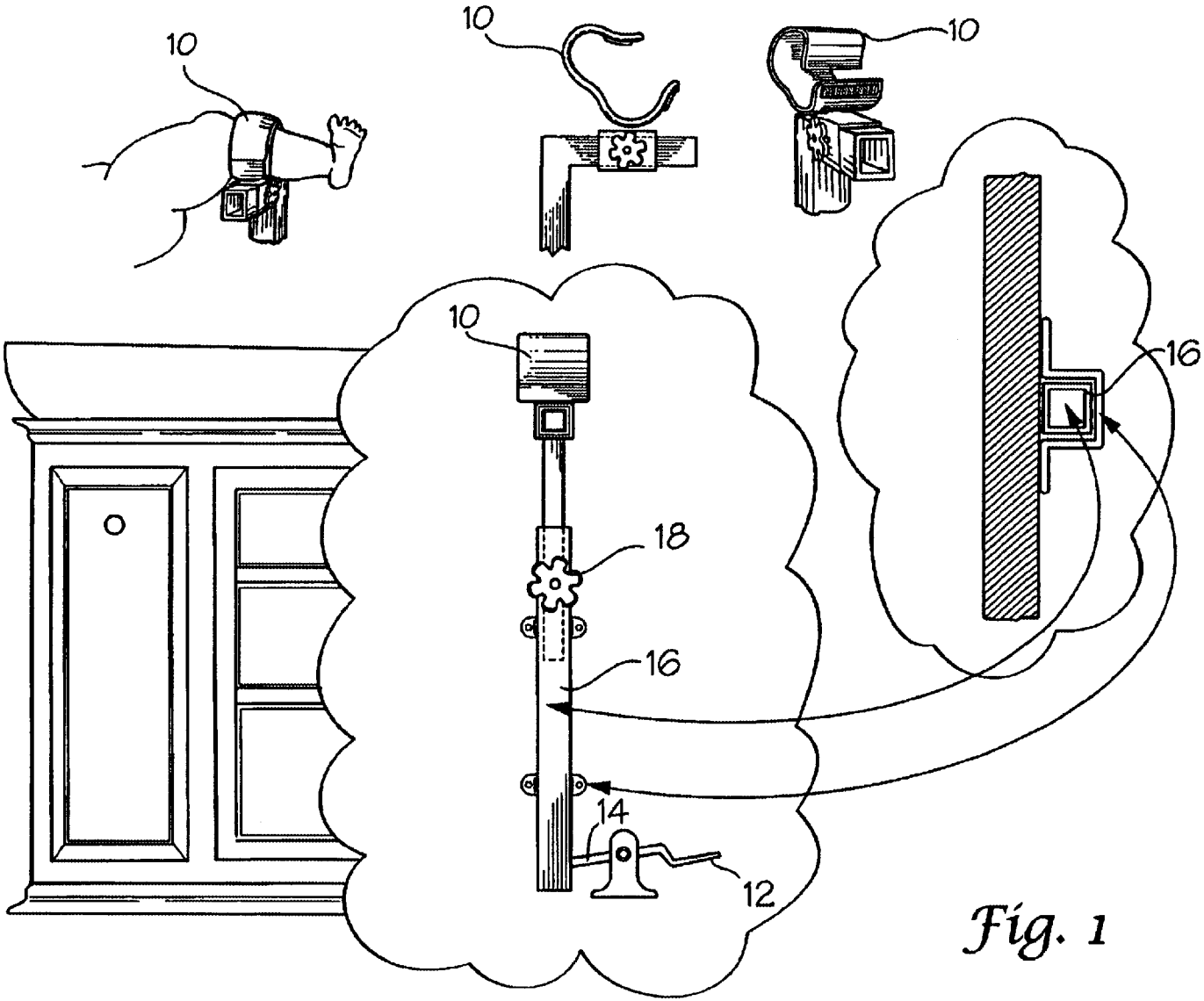
FIG. 1 is an illustration to represent the diaper-changing table and raising mechanism.

FIG. 1 discloses movement of upright rods 16 each rod would have a stirrup for holding the leg of a baby. The mechanism has a foot pedal 12 at the bottom of the piece of furniture.

The foot pedal 12 is connected to a lever 14 that lifts a horizontal crossbar and the crossbar is connected at its ends to the upright rods 16.

There is a setscrew 18 on the rods 16 that fastens the two rods together so that they do not slip.

When the person steps on the foot pedal 12 the rods 16 would move up the stirrups 10 on the upper end of the rods 16 and it would be lifted.

Figure 2:
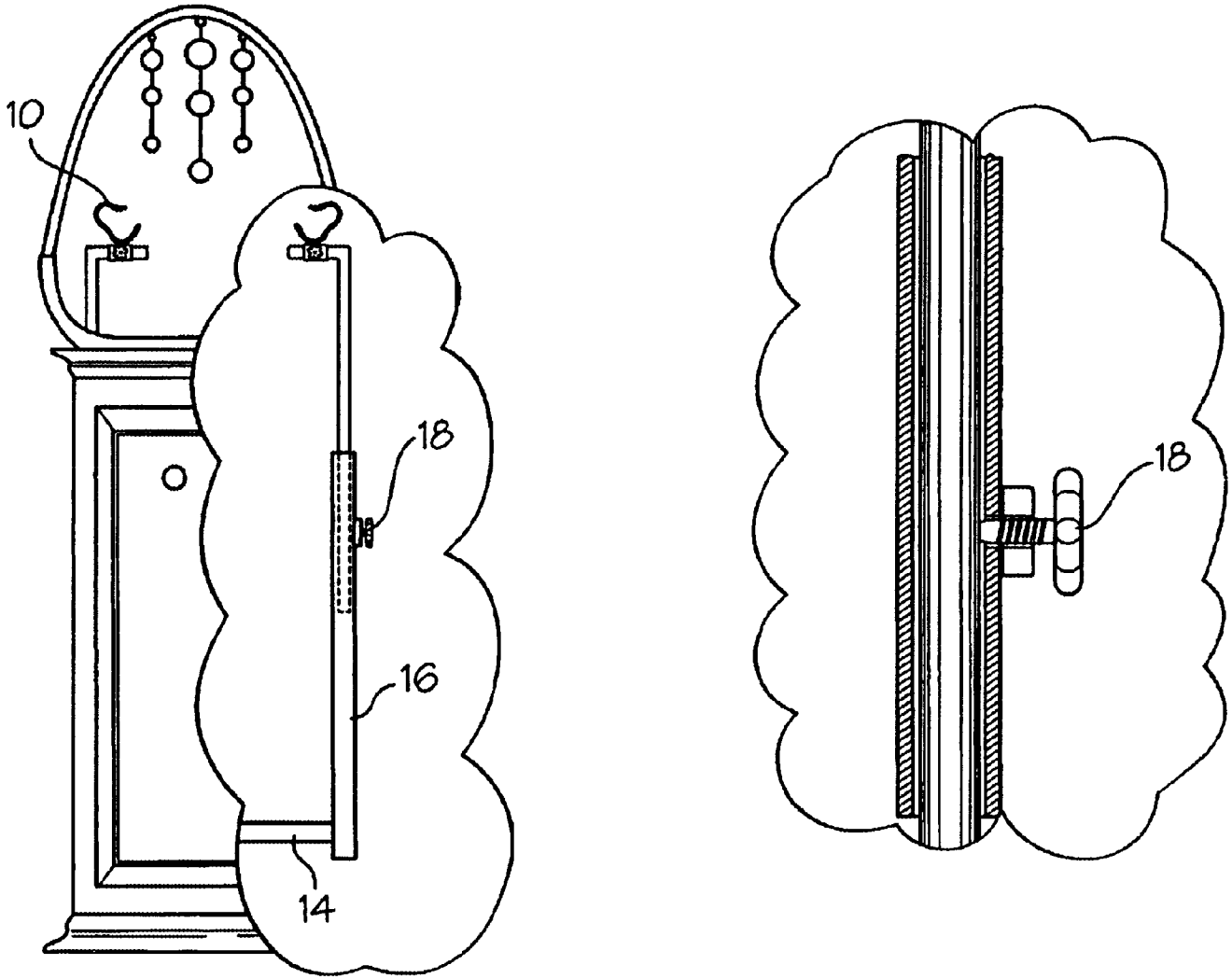
FIG. 2 is an illustration to represent the raising mechanisms and pedal as well as the rods in the diaper-changing table on its' rear side.
Figure 3:
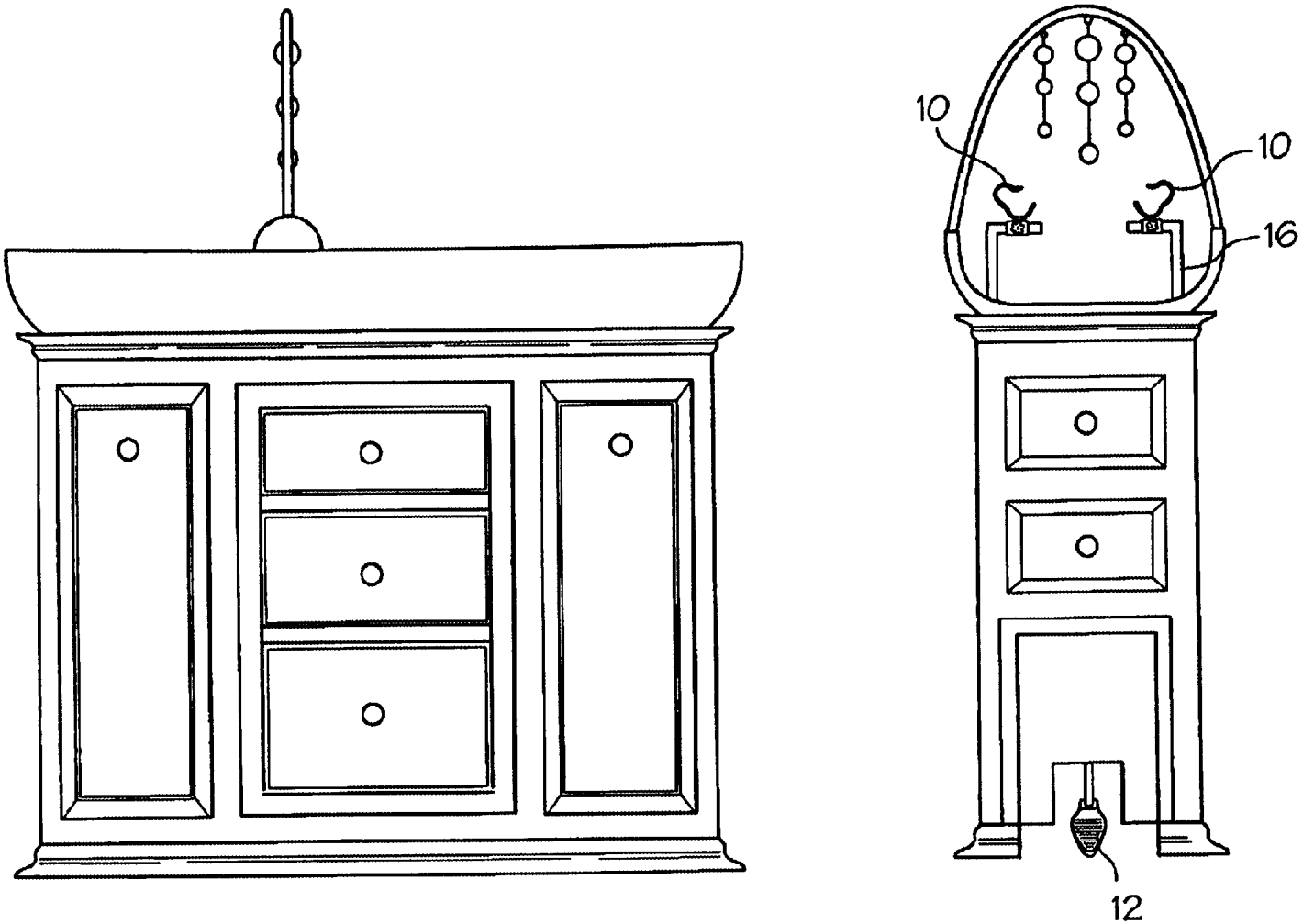
FIG. 3 is an illustration of the right side and front views of the present invention.

FIG. 2 is an illustration to give a view of the rear side of the piece of furniture where there is a foot pedal 12 on the bottom, and a lever 14 to lift a horizontal crossbar. On FIG. 2 the stirrups 10 are visible.

I claim:

1. A diaper changing table having a top surface with a pad mounted thereon, comprising:

a) a pair of elongated rods mountably disposed at one end of the changing table in an upright position;

b) a stirrup mountably disposed at the one end of each of said elongated rods;

c) said stirrups extending over the top surface of the diaper changing table;

a crossbar connecting the other end of said elongated rods;

e) a lever mountably disposed to said crossbar; and f) said lever having a first and second position, alternating between said first and said second position moves said stirrups vertically up and down over the diaper changing table's top surface.

2. A diaper changing table as recited in claim 1 wherein said pair of elongated rods each being telescopically adjustably connected.

* * * * *